US012503265B2

(12) United States Patent
Shibasaki

(10) Patent No.: US 12,503,265 B2
(45) Date of Patent: Dec. 23, 2025

(54) INFORMATION PROCESSING APPARATUS, INFORMATION PROCESSING SYSTEM, PROGRAM, AND PACKAGING APPARATUS

(71) Applicant: Taisei Lamick Group Head Quarter & Innovation Co., Ltd., Shiraoka (JP)

(72) Inventor: Tomohiro Shibasaki, Shiraoka (JP)

(73) Assignee: Taisei Lamick Group Head Quarter & Innovation Co., Ltd., Shiraoka (JP)

( * ) Notice: Subject to any disclaimer, the term of this patent is extended or adjusted under 35 U.S.C. 154(b) by 15 days.

(21) Appl. No.: 18/688,790

(22) PCT Filed: Sep. 2, 2022

(86) PCT No.: PCT/JP2022/033196
§ 371 (c)(1),
(2) Date: Mar. 4, 2024

(87) PCT Pub. No.: WO2023/058375
PCT Pub. Date: Apr. 13, 2023

(65) Prior Publication Data

US 2024/0367840 A1 Nov. 7, 2024

(30) Foreign Application Priority Data

Oct. 5, 2021 (JP) ..... 2021-164214

(51) Int. Cl.
*B65B 57/00* (2006.01)

(52) U.S. Cl.
CPC ..... *B65B 57/00* (2013.01)

(58) Field of Classification Search
USPC ..... 53/167
See application file for complete search history.

(56) References Cited

FOREIGN PATENT DOCUMENTS

JP 2009255961 A 11/2009
JP 6436156 B2 * 12/2018

OTHER PUBLICATIONS

Nov. 1, 2022, International Search Report issued in the International Patent Application No. PCT/JP2022/033196.
Apr. 9, 2024, International Preliminary Report on Patentability issued in the International Patent Application No. PCT/JP2022/033196.

* cited by examiner

*Primary Examiner* — Chinyere J Rushing-Tucker
(74) *Attorney, Agent, or Firm* — KENJA IP LAW PC

(57) ABSTRACT

An information processing apparatus (10) communicably connected to a plurality of packaging apparatuses (20) via a network (40) includes a controller (13) and a memory (12). The controller (13) is configured to acquire manufacturing information, including packaging material information, content information, and packaging conditions, from the plurality of packaging apparatuses (20) for a product obtainable by using the packaging apparatus and packaging material to package content in the packaging material, store the manufacturing information in the memory (12) by associating the packaging conditions with the packaging material information and the content information, and generate, for a first packaging condition among the packaging conditions, a first setting value distribution corresponding to the packaging material information and the content information.

10 Claims, 6 Drawing Sheets

INFORMATION PROCESSING APPARATUS, INFORMATION PROCESSING SYSTEM, PROGRAM, AND PACKAGING APPARATUS

CROSS-REFERENCE TO RELATED APPLICATION

The present application claims priority to Japanese Patent Application No. 2021-164214 filed on Oct. 5, 2021, the entire contents of which are incorporated herein by reference.

TECHNICAL FIELD

The present disclosure relates to an information processing apparatus, an information processing system, a program, and a packaging apparatus.

BACKGROUND

Conventionally, a packaging apparatus is used to manufacture products obtained by packaging contents in a wrapping material. Due to the diversity of manufacturing information, which includes packaging conditions such as packaging material composition, contents, and packaging temperature, clear standards for manufacturing have not been established, and users have had to perform a vast amount of packaging tests to determine packaging conditions.

Against this background, Patent Literature (PTL) 1, for example, discloses a packaging system for properly and easily setting up a packaging apparatus. The packaging apparatus can communicate with an external server that stores packaging setting information corresponding to the model of the packaging apparatus and the type of the item to be packaged. The packaging apparatus uses the packaging setting information to package the item to be packaged. The packaging apparatus can accept a selection of the model of the packaging apparatus and the type of the item to be packaged via a selection screen and receives, from the server, the packaging setting information corresponding to the model of the packaging apparatus and the type of the item to be packaged for which the selection was accepted.

CITATION LIST

Patent Literature

PTL 1: JP 6436156 B2

SUMMARY

Technical Problem

With conventional technology, however, the packaging setting information corresponding to the model of the packaging apparatus and the type of the item to be packaged is stored on the server as predetermined information. Users can only obtain information determined based on the selection of the model of the packaging apparatus and the type of the item to be packaged from this predetermined information. It is difficult for users to set the packaging conditions themselves freely while objectively and comprehensively understanding the packaging conditions.

The present disclosure enables users to set the packaging conditions themselves while objectively and comprehensively understanding the packaging conditions.

Solution to Problem

An information processing apparatus according to several embodiments of the present disclosure is an information processing apparatus communicably connected to a plurality of packaging apparatuses via a network, the information processing apparatus including:

- a controller and a memory, wherein the controller is configured to
  - acquire manufacturing information, including packaging material information, content information, and packaging conditions, from the plurality of packaging apparatuses for a product obtainable by using the packaging apparatus and packaging material to package content in the packaging material,
  - store the manufacturing information in the memory by associating the packaging conditions with the packaging material information and the content information, and
  - generate, for a first packaging condition among the packaging conditions, a first setting value distribution corresponding to the packaging material information and the content information.

In an embodiment, the controller may be configured to generate, for a second packaging condition among the packaging conditions, a second setting value distribution corresponding to a setting value in the first setting value distribution.

In an embodiment, the controller may be configured to generate, for a third packaging condition among the packaging conditions, a third setting value distribution corresponding to a setting value in the second setting value distribution.

In an embodiment,

- the first packaging condition may include a packaging speed,
- the second packaging condition may include a sealing temperature, and
- the third packaging condition may include a sealing pressure.

In an embodiment, the controller may be configured to execute, upon determining that the product manufactured by the packaging apparatus is a good product, a process to generate a setting value distribution using only the manufacturing information for the product determined to be a good product.

In an embodiment, the controller may be configured to determine that the product is a good product when at least one of a count of the product manufactured by the packaging apparatus and a continuous manufacturing time reaches a threshold.

In an embodiment, the controller may be configured to update a setting value distribution each time the manufacturing information is acquired from the plurality of packaging apparatuses.

An information processing system according to several embodiments of the present disclosure includes

- any of the aforementioned information processing apparatuses, and
- the plurality of packaging apparatuses configured to provide the manufacturing information to the information processing apparatus.

A program according to several embodiments of the present disclosure is configured to cause an information processing apparatus communicably connected to a plurality of packaging apparatuses via a network to execute operations, the operations including:

acquiring manufacturing information, including packaging material information, content information, and packaging conditions, from the plurality of packaging apparatuses for a product obtainable by using the packaging apparatus and packaging material to package content in the packaging material;

storing the manufacturing information by associating the packaging conditions with the packaging material information and the content information; and generating, for a first packaging condition among the packaging conditions, a first setting value distribution corresponding to the packaging material information and the content information.

A packaging apparatus according to several embodiments of the present disclosure is a packaging apparatus communicably connected to an information processing apparatus via a network, the packaging apparatus including:

a controller configured to provide manufacturing information, including packaging material information, content information, and packaging conditions, for a product obtainable by using packaging material to package content in the packaging material, acquire from the information processing apparatus, for a first packaging condition among the packaging conditions, a first setting value distribution corresponding to the packaging material information and the content information, and output, according to input from a user regarding the packaging material information and the content information, the first setting value distribution corresponding to the input to the user.

Advantageous Effect

The information processing apparatus, information processing system, program, and packaging apparatus according to embodiments of the present disclosure enable users to set the packaging conditions themselves while objectively and comprehensively understanding the packaging conditions.

DETAILED DESCRIPTION

Embodiments of the present disclosure are described below with reference to the drawings.

Figure 1:
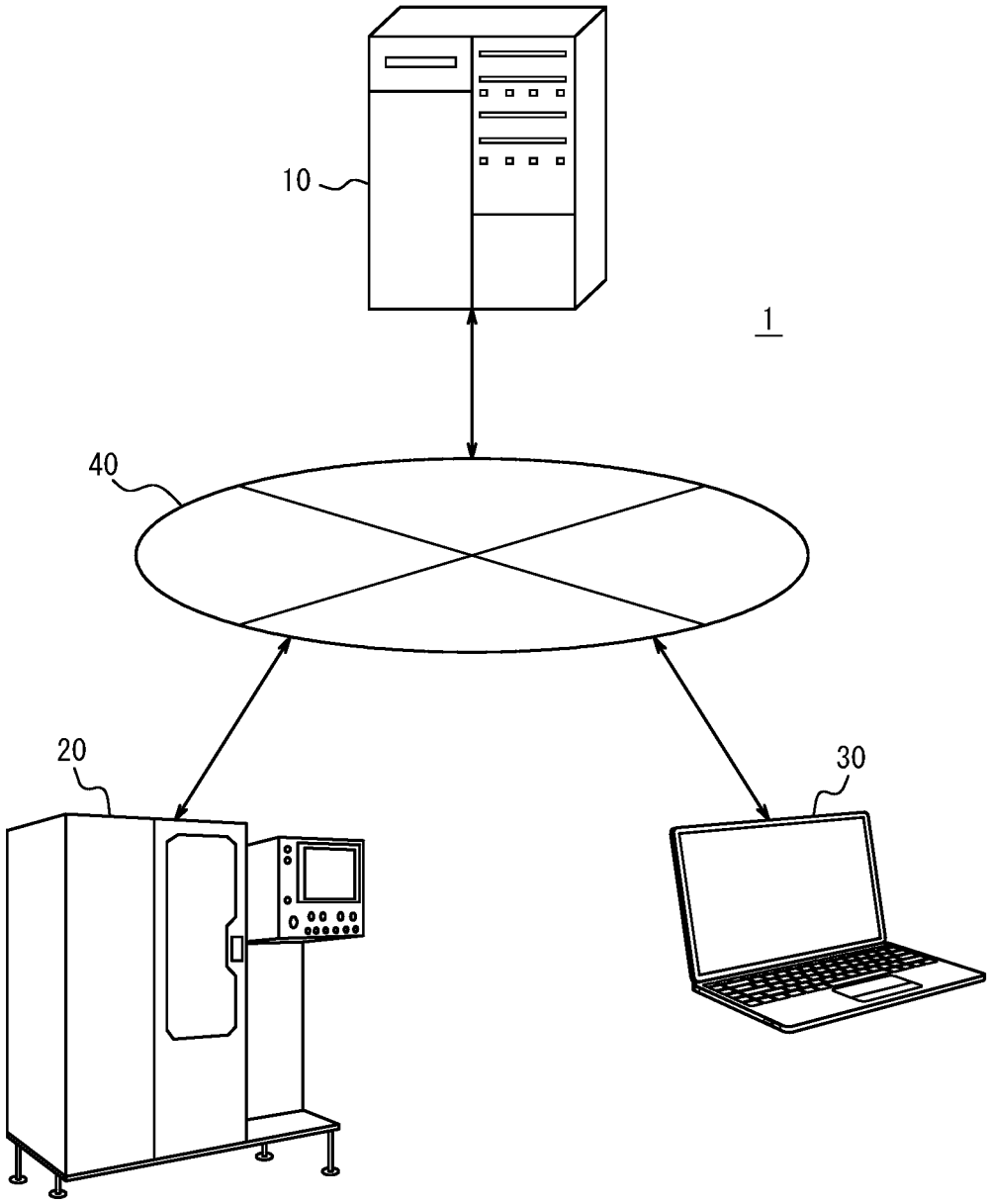
FIG. 1 is a diagram illustrating a configuration of an information processing system that includes an information processing apparatus according to an embodiment of the present disclosure.

FIG. 1 is a diagram illustrating the configuration of an information processing system 1 that includes an information processing apparatus 10 according to an embodiment of the present disclosure. An overview of the information processing system 1 including the information processing apparatus 10 according to an embodiment of the present disclosure is mainly described with reference to FIG. 1. In addition to the information processing apparatus 10, the information processing system 1 includes a plurality of sets of a packaging apparatus 20 and a terminal apparatus 30.

To simplify the explanation, FIG. 1 illustrates only one information processing apparatus 10, but the number of information processing apparatuses 10 in the information processing system 1 may be two or more. To simplify the explanation, only one set of a packaging apparatus 20 and a terminal apparatus 30 are illustrated in FIG. 1, but the information processing system 1 may include two or more sets of a packaging apparatus 20 and a terminal apparatus 30. Each of the information processing apparatus 10, the plurality of packaging apparatuses 20, and the plurality of terminal apparatuses 30 is communicably connected to a network 40 that includes, for example, a mobile communication network and the Internet.

The information processing apparatus 10 is one server apparatus or a plurality of communicably connected server apparatuses. The information processing apparatus 10 is not limited to these examples and may be any general-purpose electronic device, such as a personal computer (PC) or smartphone, or another electronic device dedicated to the information processing system 1.

The packaging apparatus 20 is any apparatus that, for example, packages contents in packaging material to manufacture a product as a package containing the contents. The packaging apparatus 20 packages the contents in the packaging material while performing a vertical sealing process and a horizontal sealing process on the packaging material based on set packaging conditions. The packaging apparatus 20 is communicably connected to the information processing apparatus 10 via the network 40.

The terminal apparatus 30 is a general-purpose electronic device, such as a PC, smartphone, or tablet terminal. The terminal apparatus 30 is, for example, an electronic device used by a user of the packaging apparatus 20. The terminal apparatus 30 is communicably connected to the packaging apparatus 20. The terminal apparatus 30 transmits input information from the user to the packaging apparatus 20 and receives output information for the user from the packaging apparatus 20. The terminal apparatus 30 is not limited to the above examples and may also be one server apparatus used by the user of the packaging apparatus 20 or a plurality of such server apparatuses that can communicate with each other, or an electronic device dedicated to the information processing system 1.

As an overview of one embodiment, the information processing apparatus 10 is communicably connected to a plurality of packaging apparatuses 20 via the network 40. The information processing apparatus 10 acquires manufacturing information, including packaging material information, content information, and packaging conditions, from the plurality of packaging apparatuses 20 for a product obtainable by using the packaging apparatus 20 and packaging material to package contents in the packaging material.

In this specification, the "packaging material" includes, for example, film, bottles, and cans. The "packaging material information" includes, for example, the packaging material composition. In a case in which the packaging material is a film, the packaging material information includes, for example, the layer composition, materials used in each layer, thickness, and film width. The packaging material information may further include information such as the manufacturer and grade of the material. The "content information" includes, for example, the type of the contents and the temperature of the contents. The contents may be liquid or solid. The "packaging conditions" include, for example, packaging speed, sealing temperature, and sealing pressure in a case in which the packaging material is a film. The sealing temperature includes a vertical sealing temperature, a horizontal sealing temperature, and the like. The sealing pressure includes a vertical sealing pressure, a horizontal sealing pressure, and the like. The sealing pressure may include at least one of pressure at one end and pressure at the other end in the width direction of the packaging material.

The information processing apparatus 10 stores the manufacturing information by associating the packaging conditions with the packaging material information and the content information. The information processing apparatus 10 generates, for a first packaging condition among the packaging conditions, a first setting value distribution corresponding to the packaging material information and the content information.

Figure 2:
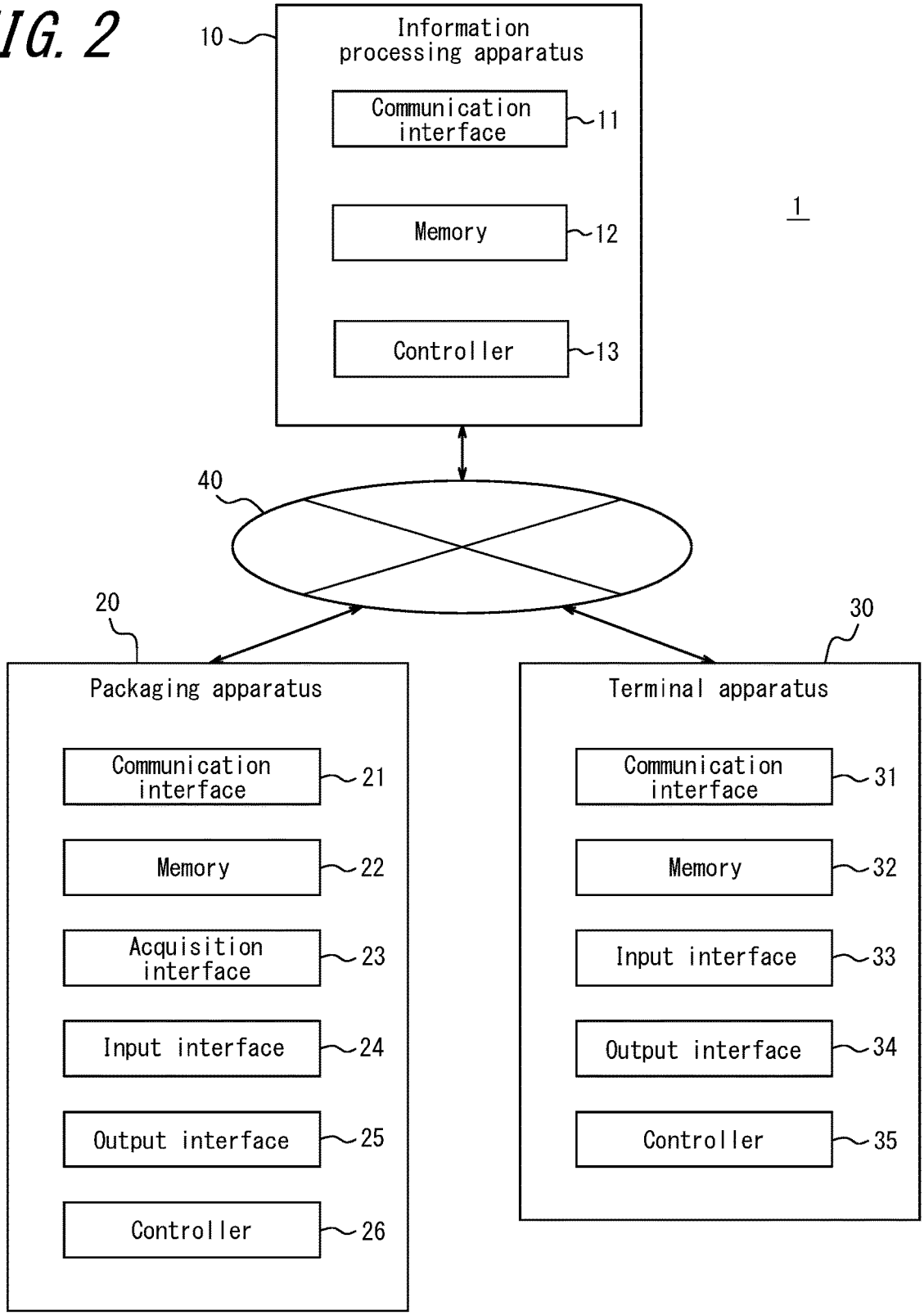
FIG. 2 is a functional block diagram schematically illustrating configurations of the information processing apparatus, the packaging apparatus, and the terminal apparatus in FIG. 1.

FIG. 2 is a functional block diagram schematically illustrating configurations of the information processing apparatus 10, the packaging apparatus 20, and the terminal apparatus 30 in FIG. 1. Example configurations of the information processing apparatus 10, the packaging apparatus 20, and the terminal apparatus 30 included in the information processing system 1 are mainly described with reference to FIG. 2.

As illustrated in FIG. 2, the information processing apparatus 10 includes a communication interface 11, a memory 12, and a controller 13.

The communication interface 11 includes a communication module that connects to the network 40. For example, the communication interface 11 includes a communication module compatible with mobile communication standards such as $4^{th}$ Generation (4G) and $5^{th}$ Generation (5G) or Internet standards. In an embodiment, the information processing apparatus 10 is connected to the network 40 via the communication interface 11. The communication interface 11 transmits and receives various information via the network 40.

The memory 12 is, for example, a semiconductor memory, a magnetic memory, an optical memory, or the like, but is not limited to these. The memory 12 functions as, for example, a main storage device, an auxiliary storage device, or a cache memory. The memory 12 stores any information used for operations of the information processing apparatus 10. For example, the memory 12 stores system programs, application programs, and various information received or transmitted by the communication interface 11. The information stored in the memory 12 can, for example, be updated with information received from the network 40 via the communication interface 11.

The controller 13 includes one or more processors. The "processor" in an embodiment is a general-purpose processor or a dedicated processor specialized for particular processing, but these examples are not limiting. The controller 13 is communicably connected with each component of the information processing apparatus 10 and controls operations of the information processing apparatus 10 overall.

The configuration of the packaging apparatus 20 included in the information processing system 1 will be mainly described. As illustrated in FIG. 2, the packaging apparatus 20 includes a communication interface 21, a memory 22, an acquisition interface 23, an input interface 24, an output interface 25, and a controller 26.

The communication interface 21 includes a communication module that connects to the network 40. For example, the communication interface 21 includes a communication module compliant with a mobile communication standard, such as 4G or 5G, or Internet standards. In an embodiment, the packaging apparatus 20 is connected to the network 40 via the communication interface 21. The communication interface 21 transmits and receives various information via the network 40.

The memory 22 is, for example, a semiconductor memory, a magnetic memory, an optical memory, or the like, but is not limited to these. The memory 22 functions as, for example, a main storage device, an auxiliary storage device, or a cache memory. The memory 22 stores any information used in operations of the packaging apparatus 20. For example, the memory 22 stores system programs, application programs, and various information received or transmitted by the communication interface 21. The information stored in the memory 22 can, for example, be updated with information received from the network 40 via the communication interface 21.

The acquisition interface 23 includes any sensor capable of acquiring the value of each parameter included in the packaging conditions. The acquisition interface 23 includes any encoder capable of acquiring the packaging speed. The acquisition interface 23 includes any thermocouple capable of acquiring the sealing temperature. The acquisition interface 23 includes any pressure sensor capable of acquiring the sealing pressure. Apart from these components, the acquisition interface 23 includes any temperature sensor capable of acquiring the temperature of the contents and any reading module capable of acquiring packaging material information regarding the packaging material being used for packaging. For example, the reading module includes any module capable of reading a two-dimensional bar code, such as a QR (Quick Response) code, and a RF (Radio Frequency) tag attached to the packaging material being used for packaging.

The input interface 24 includes one or more interfaces for input to detect user input and acquire input information based on user operations. For example, the input interface 24 may be a physical key, a capacitive key, a touchscreen provided integrally with a display of the output interface 25, a microphone that receives audio input, or the like.

The output interface 25 includes one or more interfaces for output to output information and notify the user. For example, the output interface 25 may be a display that outputs information as video, a speaker that outputs information as sound, or the like, but these examples are not limiting.

The controller 26 includes one or more processors. The "processor" in an embodiment is a general-purpose processor or a dedicated processor specialized for particular processing, but these examples are not limiting. The controller 26 is communicably connected with each component of the packaging apparatus 20 and controls overall operations of the packaging apparatus 20.

The configuration of the terminal apparatus 30 included in the information processing system 1 will be mainly described. As illustrated in FIG. 2, the terminal apparatus 30 includes a communication interface 31, a memory 32, an input interface 33, an output interface 34, and a controller 35.

The communication interface 31 includes a communication module that connects to the network 40. For example, the communication interface 31 includes a communication module compliant with a mobile communication standard, such as 4G or 5G, or Internet standards. In an embodiment, the terminal apparatus 30 is connected to the network 40 via the communication interface 31. The communication interface 31 transmits and receives various information via the network 40.

The memory 32 is, for example, a semiconductor memory, a magnetic memory, an optical memory, or the like, but is not limited to these. The memory 32 functions as, for example, a main storage device, an auxiliary storage device, or a cache memory. The memory 32 stores any information used for operations of the terminal apparatus 30. For example, the memory 32 stores system programs, application programs, and various information received or transmitted by the communication interface 31. The information stored in the memory 32 can, for example, be updated with information received from the network 40 via the communication interface 31.

The input interface 33 includes one or more interfaces for input to detect user input and acquire input information based on user operations. For example, the input interface 33 may be a physical key, a capacitive key, a touchscreen provided integrally with a display of the output interface 34, a microphone that receives audio input, or the like.

The output interface 34 includes one or more interfaces for output to output information and notify the user. For example, the output interface 34 may be a display that outputs information as video, a speaker that outputs information as sound, or the like, but these examples are not limiting.

The controller 35 includes one or more processors. The "processor" in an embodiment is a general-purpose processor or a dedicated processor specialized for particular processing, but these examples are not limiting. The controller 35 is communicably connected with each component of the terminal apparatus 30 and controls operations of the terminal apparatus 30 overall.

Figure 3:
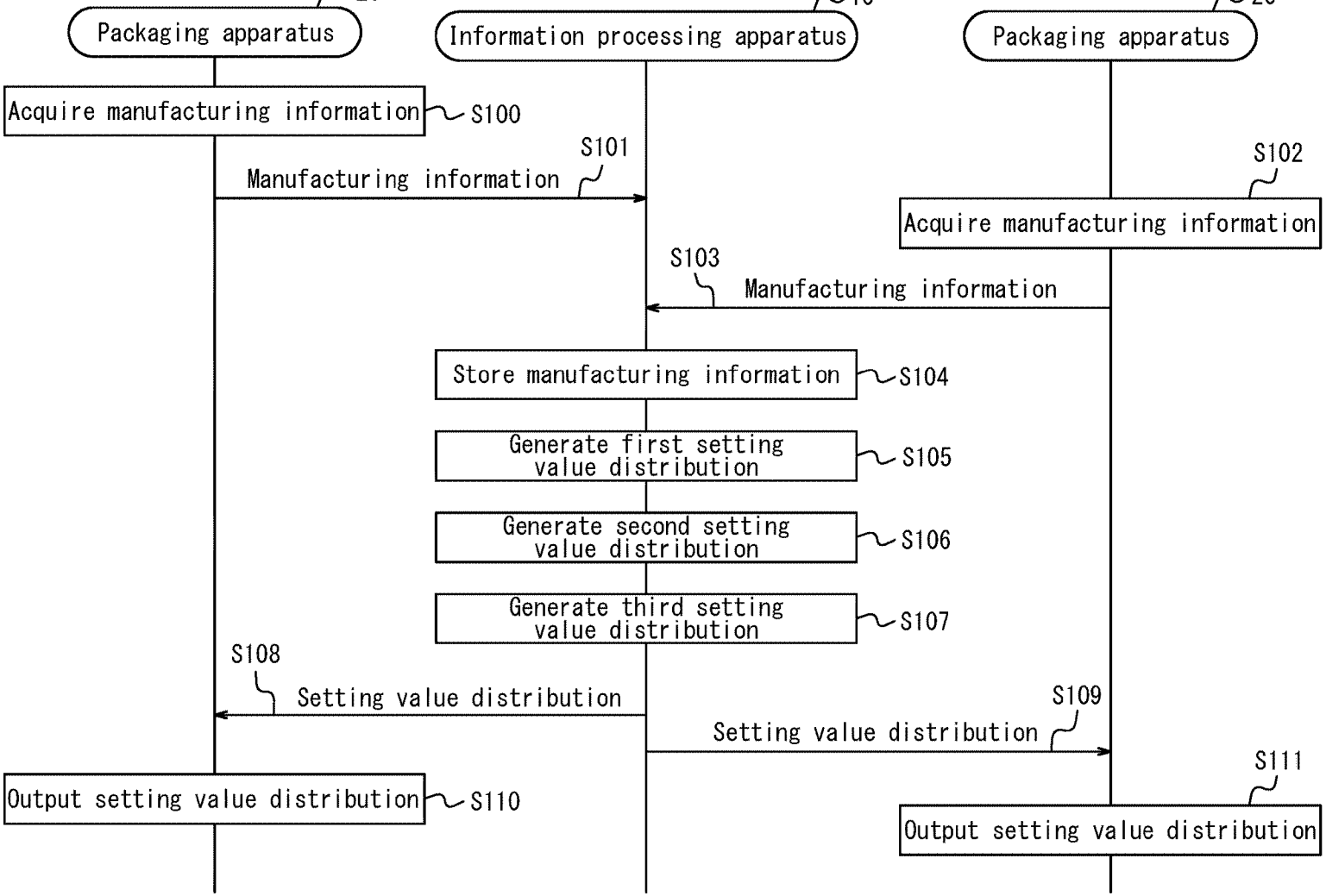
FIG. 3 is a sequence diagram illustrating an example of an information processing method executed by the information processing system in FIG. 1.

FIG. 3 is a sequence diagram illustrating an example of an information processing method executed by the information processing system 1 in FIG. 1. An example of an information processing method executed by the information processing system 1 in FIG. 1 is described with reference to FIG. 3. The sequence diagram illustrated in FIG. 3 illustrates the basic process flow of the information processing method executed by the information processing system 1.

In step S100, the controller 26 of one packaging apparatus 20 among the plurality of packaging apparatuses 20 acquires the manufacturing information including the packaging material information, the content information, and the packaging conditions using the acquisition interface 23, the input interface 24, and the like.

In step S101, the controller 26 of the one packaging apparatus 20 among the plurality of packaging apparatuses 20 transmits the manufacturing information acquired in step S100 to the information processing apparatus 10 via the communication interface 21 and the network 40.

In step S102, the controller 26 of another packaging apparatus 20 among the plurality of packaging apparatuses 20 acquires the manufacturing information including the packaging material information, the content information, and the packaging conditions using the acquisition interface 23, the input interface 24, and the like.

In step S103, the controller 26 of the other packaging apparatus 20 among the plurality of packaging apparatuses 20 transmits the manufacturing information acquired in step S102 to the information processing apparatus 10 via the communication interface 21 and the network 40.

As in steps S101 and S103 above, the controller 26 of the packaging apparatus 20 provides the manufacturing information, including the packaging material information, the content information, and the packaging conditions, to the information processing apparatus 10 for a product obtainable by using the packaging material to package contents in the packaging material. The controller 13 of the information processing apparatus 10 acquires the manufacturing information from the plurality of packaging apparatuses 20 for a product obtainable by using the packaging apparatus 20 and the packaging material to package contents in the packaging material.

In step S104, the controller 13 of the information processing apparatus 10 stores the manufacturing information acquired in steps S101 and S103 in the memory 12 by associating the packaging conditions with the packaging material information and the content information. The controller 13 of the information processing apparatus 10 stores the manufacturing information acquired in steps S101 and S103 in a database in the memory 12.

In step S105, the controller 13 of the information processing apparatus 10 generates, for a first packaging condition among the packaging conditions stored in the memory 12 in step S104, a first setting value distribution corresponding to the packaging material information and the content information.

In step S106, the controller 13 of the information processing apparatus 10 generates, for a second packaging condition among the packaging conditions stored in the memory 12 in step S104, a second setting value distribution corresponding to a setting value in the first setting value distribution generated in step S105.

In step S107, the controller 13 of the information processing apparatus 10 generates, for a third packaging condition among the packaging conditions stored in the memory 12 in step S104, a third setting value distribution corresponding to a setting value in the second setting value distribution generated in step S106.

Here, the setting value distributions including the first setting value distribution, the second setting value distribution, and the third setting value distribution are, for example, indicated by a graph, for each setting value, plotting the ratio of the setting value in the entire plurality of setting values acquired from the plurality of packaging apparatuses 20 for the corresponding packaging condition.

In step S108, the controller 13 of the information processing apparatus 10 transmits the setting value distributions generated in steps S105 through S107 to the one packaging apparatus 20 among the plurality of packaging apparatuses 20 via the communication interface 11 and the network 40.

The controller 26 of the one packaging apparatus 20 thus acquires, from the information processing apparatus 10, the first setting value distribution corresponding to the packaging material information and the content information for the first packaging condition among the packaging conditions. The controller 26 of the one packaging apparatus 20 acquires, from the information processing apparatus 10, the second setting value distribution, corresponding to a setting value in the first setting value distribution, for the second packaging condition among the packaging conditions. The controller 26 of the one packaging apparatus 20 acquires, from the information processing apparatus 10, the third setting value distribution, corresponding to a setting value in the second setting value distribution, for the third packaging condition among the packaging conditions.

In step S109, the controller 13 of the information processing apparatus 10 transmits the setting value distributions generated in steps S105 through S107 to the other packaging apparatus 20 among the plurality of packaging apparatuses 20 via the communication interface 11 and the network 40.

The controller 26 of the other packaging apparatus 20 thus acquires, from the information processing apparatus 10, the first setting value distribution corresponding to the packaging material information and the content information for the first packaging condition among the packaging conditions. The controller 26 of the other packaging apparatus 20 acquires, from the information processing apparatus 10, the second setting value distribution, corresponding to a setting value in the first setting value distribution, for the second packaging condition among the packaging conditions. The controller 26 of the other packaging apparatus 20 acquires, from the information processing apparatus 10, the third setting value distribution, corresponding to a setting value in the second setting value distribution, for the third packaging condition among the packaging conditions.

In step S110, the controller 26 of the one packaging apparatus 20 outputs, according to input from a user regarding the packaging material information and the content information, the first setting value distribution corresponding to the input to the user. For example, the controller 26 outputs the corresponding first setting value distribution to the user via the output interface 34 of the terminal apparatus 30 according to the packaging material information and the content information inputted by the user using the input interface 33 of the terminal apparatus 30 that is communicably connected to the one packaging apparatus 20. Similarly, the controller 26 of the one packaging apparatus 20 outputs the corresponding second setting value distribution to the user via the output interface 34 according to input from the user, using the input interface 33, regarding the first setting value distribution. Similarly, the controller 26 of the one packaging apparatus 20 outputs the corresponding third setting value distribution to the user via the output interface 34 according to input from the user, using the input interface 33, regarding the second setting value distribution.

In step S111, the controller 26 of the other packaging apparatus 20 outputs, according to input from a user regarding the packaging material information and the content information, the first setting value distribution corresponding to the input to the user. For example, the controller 26 outputs the corresponding first setting value distribution to the user via the output interface 34 of the terminal apparatus 30 according to the packaging material information and the content information inputted by the user using the input interface 33 of the terminal apparatus 30 that is communicably connected to the other packaging apparatus 20. Similarly, the controller 26 of the other packaging apparatus 20 outputs the corresponding second setting value distribution to the user via the output interface 34 according to input from the user, using the input interface 33, regarding the first setting value distribution. Similarly, the controller 26 of the other packaging apparatus 20 outputs the corresponding third setting value distribution to the user via the output interface 34 according to input from the user, using the input interface 33, regarding the second setting value distribution.

The controller 13 of the information processing apparatus 10 subsequently updates the setting value distribution each time the manufacturing information is acquired from the plurality of packaging apparatuses 20.

Figure 4:
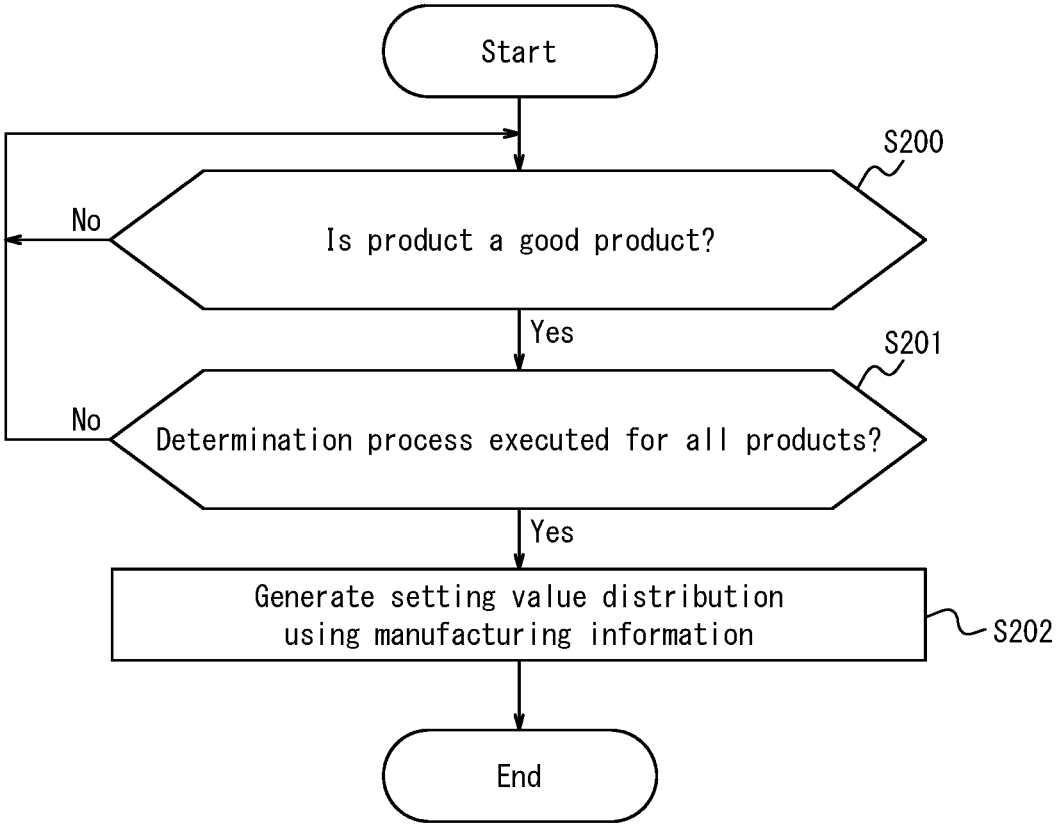
FIG. 4 is a flowchart for explaining an example of an information processing method executed by the information processing apparatus in FIG. 1.

FIG. 4 is a flowchart for explaining an example of an information processing method executed by the information processing apparatus 10 in FIG. 1. An example of an information processing method executed by the information processing apparatus 10 in FIG. 1 is described with reference to FIG. 4. The flowchart illustrated in FIG. 4 illustrates the determination process before the information processing apparatus 10 executes the process of generating the setting value distribution in steps S105 to S107 in FIG. 3.

In step S200, the controller 13 determines whether the product manufactured by the packaging apparatus 20 is a good product using the manufacturing information acquired in steps S101 and S103 of FIG. 3. If the controller 13 determines that the product is a good product, the controller 13 executes the process in step S201. If the controller 13 determines that the product is not a good product, i.e., defective, the controller 13 executes the process in step S200 again for a different product.

For example, the controller 13 determines that the product is a good product when at least one of the count of products manufactured by the packaging apparatus 20 and a continuous manufacturing time reaches a threshold. The controller 13 assumes that the product is a good product if products were manufactured consistently and continuously by the packaging apparatus 20. On the other hand, the controller 13 assumes that the product is defective if neither the count of products manufactured by the packaging apparatus 20 nor the continuous manufacturing time reaches the threshold, i.e., if manufacturing was not continuous but rather was interrupted early. The above thresholds are defined as appropriate by the service provider that manages the information processing system 1, for example.

In step S201, the controller 13 determines whether the determination process in step S200 has been executed for all products. If the controller 13 determines that the determination process has been executed for all products, the controller 13 executes the process in step S202. If the controller 13 determines that the determination process has not been executed for all products, the controller 13 executes the process in step S200 again.

In step S202, the controller 13 executes the process of generating the setting value distribution in steps S105 to S107 in FIG. 3 using only the manufacturing information for the product determined to be a good product in step S200.

In the following, an example of the flow when the user determines packaging conditions for the packaging apparatus 20 while using the setting value distribution generated by the information processing apparatus 10 will be explained with reference to FIGS. 5 to 7. In the explanation using FIGS. 5 to 7, the first packaging condition includes the packaging speed. The second packaging condition includes the sealing temperature, e.g., the vertical sealing temperature. The third packaging condition includes the sealing pressure, e.g., the vertical sealing left pressure.

Figure 5:
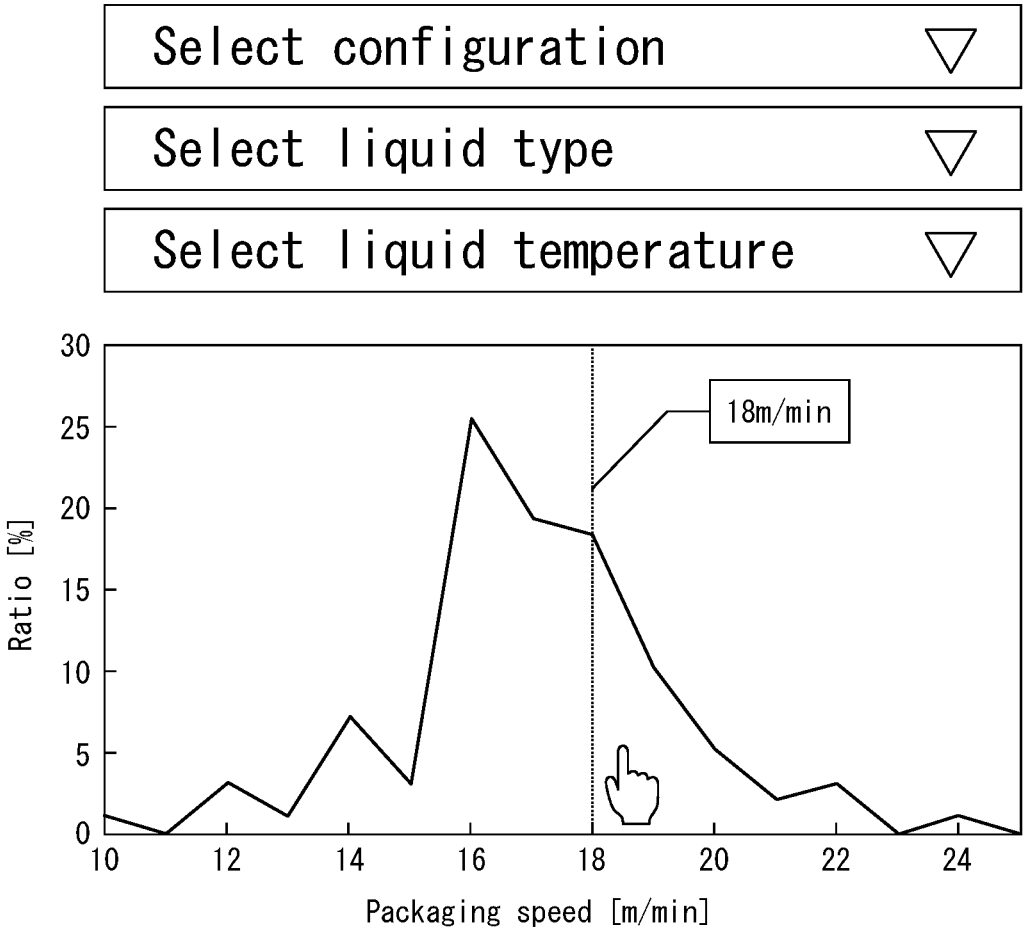
FIG. 5 is a schematic diagram illustrating an example of an output image, including a first setting value distribution, displayed on an output interface of a terminal apparatus communicably connected to a packaging apparatus.

FIG. 5 is a schematic diagram illustrating an example of an output image, including a first setting value distribution, displayed on the output interface 34 of the terminal apparatus 30 communicably connected to the packaging apparatus 20.

Upon acquiring the setting value distribution from the information processing apparatus 10, the controller 26 of the packaging apparatus 20 outputs an image as illustrated in FIG. 5, including the first setting value distribution, to the user via the output interface 34 of the terminal apparatus 30. While viewing the image outputted on the output interface 34 of the terminal apparatus 30, the user uses the input interface 33 of the terminal apparatus 30 to select or input, in the "Select configuration" field, the packaging material information for the product to be manufactured using the packaging apparatus 20. The user then uses the input interface 33 of the terminal apparatus 30 to select or input, in the "Select liquid type" and "Select liquid temperature" fields, the content information for the product to be manufactured using the packaging apparatus 20.

The controller 26 of the packaging apparatus 20 outputs, to the output interface 34 of the terminal apparatus 30, the first setting value distribution corresponding to the packaging material information and content information selected or inputted by the user using the input interface 33 of the terminal apparatus 30. While viewing the first setting value distribution outputted on the output interface 34 of the terminal apparatus 30, the user selects the setting value of the desired packaging speed from the first setting value distribution using the input interface 33 of the terminal apparatus 30. For example, the user selects the setting value of 18 m/min, which is included in the center of the distribution in the first setting value distribution, using the input interface 33 of the terminal apparatus 30.

Figure 6:
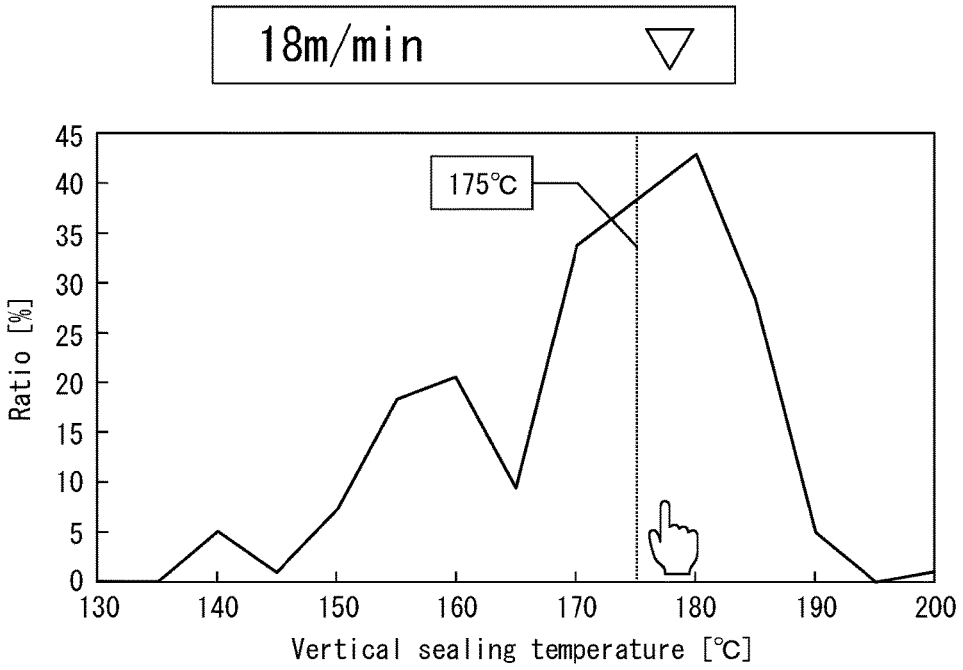
FIG. 6 is a schematic diagram illustrating an example of an output image, including a second setting value distribution, displayed on an output interface of a terminal apparatus communicably connected to a packaging apparatus.

FIG. 6 is a schematic diagram illustrating an example of an output image, including a second setting value distribution, displayed on the output interface 34 of the terminal apparatus 30 communicably connected to the packaging apparatus 20.

The controller 26 of the packaging apparatus 20 outputs, to the output interface 34 of the terminal apparatus 30, the second setting value distribution corresponding to the setting value of 18 m/min in the first setting value distribution as selected by the user using the input interface 33 of the terminal apparatus 30. While viewing the second setting value distribution outputted on the output interface 34 of the terminal apparatus 30, the user selects the setting value of the desired vertical sealing temperature from the second setting value distribution using the input interface 33 of the terminal apparatus 30. For example, the user selects the setting value of 175° C., which exhibits a large ratio in the second setting value distribution, using the input interface 33 of the terminal apparatus 30.

Figure 7:
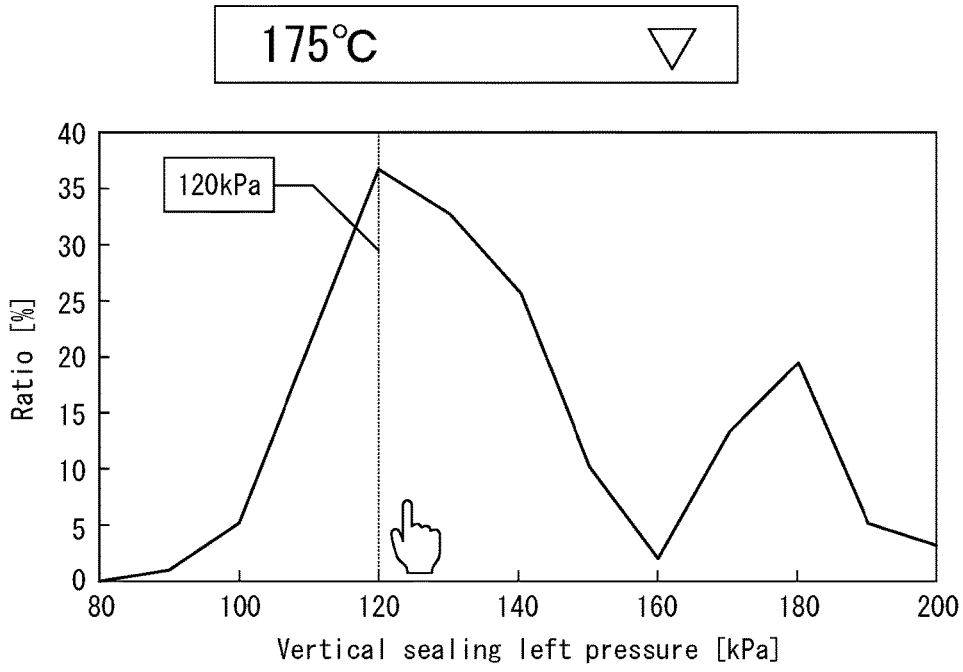
FIG. 7 is a schematic diagram illustrating an example of an output image, including a third setting value distribution, displayed on an output interface of a terminal apparatus communicably connected to a packaging apparatus.

FIG. 7 is a schematic diagram illustrating an example of an output image, including a third setting value distribution, displayed on the output interface 34 of the terminal apparatus 30 communicably connected to the packaging apparatus 20.

The controller 26 of the packaging apparatus 20 outputs, to the output interface 34 of the terminal apparatus 30, the third setting value distribution corresponding to the setting value of 175° C. in the second setting value distribution as selected by the user using the input interface 33 of the terminal apparatus 30. While viewing the third setting value distribution outputted on the output interface 34 of the terminal apparatus 30, the user selects the setting value of the desired vertical sealing left pressure from the third setting value distribution using the input interface 33 of the terminal apparatus 30. For example, the user selects the setting value of 120 kPa, which exhibits a large ratio in the third setting value distribution, using the input interface 33 of the terminal apparatus 30. At this time, the controller 26 of the packaging apparatus 20 calculates an appropriate setting value for the vertical sealing right pressure based on the selected setting value of 120 kPa for the vertical sealing left pressure and the film width.

According to the embodiment described above, users can set the packaging conditions themselves while objectively and comprehensively understanding the packaging conditions. For example, the information processing apparatus 10 acquires manufacturing information from the plurality of packaging apparatuses 20 to generate the first setting value distribution. In this way, the information processing apparatus 10 can collectively present to the user, as objective and comprehensive information, the setting values that a plurality of users using respective packaging apparatuses 20 each selected for the first packaging condition. By confirming the first setting value distribution, users can objectively grasp the position of the setting value they are about to select among all of the setting values selected by the plurality of users who use the respective packaging apparatuses 20. The user can also objectively evaluate the adequacy of the productivity of the product based on the actually derived first packaging condition.

In addition, by confirming the first setting value distribution, the user can easily grasp the appropriate range of setting values for the first packaging condition according to the packaging material information and content information selected or inputted by the user. It thus becomes easier for the user to derive an appropriate condition for the first packaging condition. The user can easily select a setting value from an appropriate range of setting values for the first packaging condition.

For example, a user can easily select a setting value that is selected relatively often by other users. For example, the user can easily identify the upper and lower limits of setting values for the first packaging condition. The user may therefore venture to select an extreme first packaging condition as compared to the average first packaging condition. For example, when wishing to increase the production speed as much as possible while assuring product quality, the user can easily grasp how much the average packaging speed of 18 m/min illustrated in FIG. 5 can be increased based on the first setting value distribution. The user can also easily ascertain the packaging conditions that will improve the production speed while ensuring product quality. Thus, even users who are not directly engaged in the production of the product can to some degree predict the adequacy of the production speed and can easily evaluate the production cost.

The packaging conditions are selected by the user as described above. Therefore, the manufacturer that provides the packaging apparatus 20 to the user does not need to create its own formulas or the like for packaging conditions during manufacturing of the packaging apparatus 20. The manufacturer can also use manufacturing information, aggregated on the information processing apparatus 10 from a plurality of packaging apparatuses 20, for other functions such as cost calculation. In addition, the manufacturer may use this manufacturing information for consulting services related to improving production efficiency or the like when the user manufactures products using the packaging apparatus 20. The manufacturer can also reduce the need to dispatch workers to the site where the user is actually using the packaging apparatus 20, since the manufacturing of products by the user using the packaging apparatus 20 is optimized. This enables the manufacturer to reduce costs, such as personnel costs and working hours.

The information processing apparatus 10 can achieve the same effects as described above by generating, for the second packaging condition among the packaging conditions, the second setting value distribution corresponding to a setting value in the first setting value distribution.

The information processing apparatus 10 can achieve the same effects as described above by generating, for the third packaging condition among the packaging conditions, the third setting value distribution corresponding to a setting value in the second setting value distribution.

The information processing apparatus 10 more significantly achieves the aforementioned effects by generating the second setting value distribution and the third setting value distribution in addition to the first setting value distribution.

The information processing apparatus 10 can improve the accuracy and reliability of the setting value distribution by executing the process of generating the setting value distribution using only the manufacturing information for products determined to be a good product manufactured by the packaging apparatus 20. If the setting value distribution is generated using only the manufacturing information for products determined to be a good product, the user can have greater confidence in the setting value distribution and select the packaging conditions with peace of mind. The convenience for the user of the information processing system 1 therefore also improves.

By determining that a product is a good product when at least one of the count of products manufactured by the packaging apparatus 20 and the continuous manufacturing time reaches a threshold, the information processing apparatus 10 can provide an objective indicator to such a determination process. The information processing apparatus 10 can therefore improve the accuracy of the process to determine whether a product is a good product and can consequently further improve the accuracy and reliability of the setting value distribution.

The information processing apparatus 10 can automatically optimize the setting value distribution based on the latest manufacturing information by updating the setting value distribution each time the manufacturing information is acquired from the plurality of packaging apparatuses 20. The information processing apparatus 10 can provide the optimized, updated setting value distribution to the user with improved accuracy and reliability as information necessary for selecting packaging conditions.

The above effects also apply to the information processing system 1, the packaging apparatus 20, and the terminal apparatus 30 according to an embodiment.

Although the present disclosure is based on embodiments and drawings, it is to be noted that various changes and modifications may be made by those skilled in the art based on the present disclosure. Therefore, such changes and modifications are to be understood as included within the scope of the present disclosure. For example, the functions and the like included in the various configurations and steps may be reordered in any logically consistent way. Furthermore, components or steps may be combined into one or divided.

At least a portion of the processing operations executed by the information processing apparatus 10 in the above embodiment may be executed by the packaging apparatus 20 or the terminal apparatus 30, for example. At least a portion of the processing operations executed by the packaging apparatus 20 or the terminal apparatus 30 may be executed by the information processing apparatus 10.

For example, a general-purpose electronic device, such as a smartphone or a computer, can also be configured to function as the information processing apparatus 10 according to the above embodiment. Specifically, a program describing the processing content for realizing the functions of the information processing apparatus 10 or the like according to an embodiment is stored in a memory of the electronic device, and the program is read and executed by the processor of the electronic device. Accordingly, the present disclosure can also be embodied as a program executable by a processor.

Alternatively, an embodiment can also be realized as a non-transitory computer readable medium storing a program executable by one or more processors to cause the information processing apparatus 10 or the like according to an embodiment to execute each function. Such embodiments are also to be understood as falling within the scope of the present disclosure.

The information processing apparatus 10 in the above embodiment has been described as generating, for the second packaging condition among the packaging conditions, the second setting value distribution corresponding to a setting value in the first setting value distribution, but this configuration is not limiting. The information processing apparatus 10 need not generate such a second setting value distribution.

The information processing apparatus 10 in the above embodiment has been described as generating, for the third packaging condition among the packaging conditions, the third setting value distribution corresponding to a setting value in the second setting value distribution, but this configuration is not limiting. The information processing apparatus 10 need not generate such a third setting value distribution.

The information processing apparatus 10 in the above embodiment has been described as generating setting value distributions for three packaging conditions, i.e., the first packaging condition, the second packaging condition, and the third packaging condition, but this configuration is not limiting. The information processing apparatus 10 may generate setting value distributions for four or more packaging conditions.

In the above embodiment, the first packaging condition includes the packaging speed, the second packaging condition includes the sealing temperature, and the third packaging condition includes the sealing pressure, but this configuration is not limiting. Each of the first packaging condition, the second packaging condition, and the third packaging condition may include any other parameter that the user can set as a packaging condition when manufacturing a product using the packaging apparatus 20.

In the above embodiment, the information processing apparatus 10 has been described as executing the process of generating the setting value distribution using only the manufacturing information for products determined to have been a good product manufactured by the packaging apparatus 20, but this configuration is not limiting. The information processing apparatus 10 may use all of the manufacturing information, acquired from the plurality of packaging apparatuses 20, in the process of generating the setting value distribution without executing such a determination process. In such a case, the setting value distribution generated by the information processing apparatus 10 includes a predetermined proportion of setting values based on manufacturing information for defective products. However, for such setting values, the ratio of the number of data points for defective products to good products is extremely small. The information processing apparatus 10 can therefore suppress, to some degree, a decline in accuracy of the setting value distribution.

In the above embodiment, the information processing apparatus 10 has been described as executing a process to determine whether the product manufactured by the packaging apparatus 20 is a good, but this configuration is not limiting. The packaging apparatus 20 or the terminal apparatus 30 may execute such a determination process. The packaging apparatus 20 may provide the information processing apparatus 10 with only the manufacturing information about products determined by the packaging apparatus 20 or the terminal apparatus 30 to be good products manufactured by the packaging apparatus 20.

In the above embodiment, the information processing apparatus 10 has been described as determining that a product is a good product when at least one of the count of products manufactured by the packaging apparatus 20 and the continuous manufacturing time reaches a threshold, but this configuration is not limiting. The information processing apparatus 10 may execute such a determination process based on any other objective index.

In the above embodiment, the information processing apparatus 10 has been described as updating the setting value distribution each time the manufacturing information is acquired from the plurality of packaging apparatuses 20, but this configuration is not limiting. The information processing apparatus 10 may periodically or non-periodically update the setting value distribution based on the manufacturing information acquired from the plurality of packaging apparatuses 20.

In the above embodiment, the controller 26 of the packaging apparatus 20 has been described as acquiring the manufacturing information using the acquisition interface 23, the input interface 24, and the like in steps S100 and S102 of FIG. 3, but this configuration is not limiting. The controller 26 of the packaging apparatus 20 may acquire, from the terminal apparatus 30, manufacturing information that was entered by the user using the input interface 33 of the terminal apparatus 30.

In the above embodiment, the controller 26 of the packaging apparatus 20 has been described as outputting the corresponding setting value distribution to the user, via the output interface 34 of the terminal apparatus 30, according to input entered by the user using the input interface 33 of the terminal apparatus 30, but this configuration is not limiting. The controller 26 of the packaging apparatus 20 may output the corresponding setting value distribution to the user, via the output interface 25 of the packaging apparatus 20, according to input entered by the user using the input interface 24 of the packaging apparatus 20.

REFERENCE SIGNS LIST

1 Information processing system
10 Information processing apparatus
11 Communication interface
12 Memory
13 Controller
20 Packaging apparatus
21 Communication interface
22 Memory
23 Acquisition interface
24 Input interface
25 Output interface
26 Controller
30 Terminal apparatus
31 Communication interface
32 Memory
33 Input interface
34 Output interface
35 Controller
40 Network

The invention claimed is:

1. An information processing apparatus communicably connected to a plurality of packaging apparatuses via a network, the information processing apparatus comprising:

a controller and a memory, wherein the controller is configured to acquire manufacturing information, including packaging material information, content information, and packaging conditions, from the plurality of packaging apparatuses for a product obtainable by using the packaging apparatus and packaging material to package content in the packaging material, store the manufacturing information in the memory by associating the packaging conditions with the packaging material information and the content information, and generate, for a first packaging condition among the packaging conditions, a first setting value distribution corresponding to the packaging material information and the content information, wherein the first setting value distribution is indicated by a graph plotting, for each of a plurality of setting values for the first packaging condition, a ratio of the respective setting value within setting values acquired from the plurality of packaging apparatuses.

2. The information processing apparatus according to claim 1, wherein the controller is configured to generate, for a second packaging condition among the packaging conditions, a second setting value distribution corresponding to a setting value in the first setting value distribution.

3. The information processing apparatus according to claim 2, wherein the controller is configured to generate, for a third packaging condition among the packaging conditions, a third setting value distribution corresponding to a setting value in the second setting value distribution.

4. The information processing apparatus according to claim 3, wherein the first packaging condition includes a packaging speed, the second packaging condition includes a sealing temperature, and the third packaging condition includes a sealing pressure.

5. The information processing apparatus according to claim 1, wherein the controller is configured to execute, upon determining that the product manufactured by the packaging apparatus is a good product, a process to generate a setting value distribution using only the manufacturing information for the product determined to be a good product.

6. The information processing apparatus according to claim 5, wherein the controller is configured to determine that the product is a good product when at least one of a count of the product manufactured by the packaging apparatus and a continuous manufacturing time reaches a threshold.

7. The information processing apparatus according to claim 1, wherein the controller is configured to update a setting value distribution each time the manufacturing information is acquired from the plurality of packaging apparatuses.

8. An information processing system comprising:

the information processing apparatus according to claim 1; and the plurality of packaging apparatuses configured to provide the manufacturing information to the information processing apparatus.

9. A program configured to cause an information processing apparatus communicably connected to a plurality of packaging apparatuses via a network to execute operations, the operations comprising:

acquiring manufacturing information, including packaging material information, content information, and packaging conditions, from the plurality of packaging apparatuses for a product obtainable by using the packaging apparatus and packaging material to package content in the packaging material;

storing the manufacturing information by associating the packaging conditions with the packaging material information and the content information; and generating, for a first packaging condition among the packaging conditions, a first setting value distribution corresponding to the packaging material information and the content information, wherein the first setting value distribution is indicated by a graph plotting, for each of a plurality of setting values for the first packaging condition, a ratio of the respective setting value within setting values acquired from the plurality of packaging apparatuses.

10. A packaging apparatus communicably connected to an information processing apparatus via a network, the packaging apparatus comprising:

a controller configured to provide manufacturing information, including packaging material information, content information, and packaging conditions, for a product obtainable by using packaging material to package content in the packaging material, acquire from the information processing apparatus, for a first packaging condition among the packaging conditions, a first setting value distribution corresponding to the packaging material information and the content information, and output, according to input from a user regarding the packaging material information and the content information, the first setting value distribution corresponding to the input to the user, wherein the first setting value distribution is indicated by a graph plotting, for each of a plurality of setting values for the first packaging condition, a ratio of the respective setting value within setting values acquired from the plurality of packaging apparatuses.

* * * * *